US008113738B2

(12) United States Patent
Mahler et al.

(10) Patent No.: US 8,113,738 B2
(45) Date of Patent: Feb. 14, 2012

(54) DEVICE FOR COMPACTING ROAD PAVING MATERIALS

(75) Inventors: Anton Mahler, Wennigsen (DE); Marc Niggemann, Hameln (DE); Oliver Lachmann, Hameln (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 0 days.

(21) Appl. No.: 12/865,825

(22) PCT Filed: Jan. 6, 2009

(86) PCT No.: PCT/EP2009/000026

§ 371 (c)(1),
(2), (4) Date: Aug. 18, 2010

(87) PCT Pub. No.: WO2009/095146

PCT Pub. Date: Aug. 6, 2009

(65) Prior Publication Data

US 2011/0002738 A1 Jan. 6, 2011

(30) Foreign Application Priority Data

Feb. 2, 2008 (DE) ..... 10 2008 007 307

(51) Int. Cl.
*E01C 23/14* (2006.01)

(52) U.S. Cl. ..... 404/95; 404/118; 404/133.2

(58) Field of Classification Search ..... 404/95, 404/118, 133.2; 219/672, 673
See application file for complete search history.

(56) References Cited

U.S. PATENT DOCUMENTS

| | | | | |
|---|---|---|---|---|
| 4,493,585 | A * | 1/1985 | Axer | 404/102 |
| 5,259,693 | A * | 11/1993 | Raymond | 404/95 |
| 5,417,516 | A * | 5/1995 | Birtchet | 404/71 |
| 6,124,580 | A * | 9/2000 | Nottmeier et al. | 219/635 |
| 6,318,928 | B1 * | 11/2001 | Swearingen | 404/72 |
| 6,981,820 | B2 * | 1/2006 | Nelson | 404/118 |
| 7,427,174 | B2 * | 9/2008 | Dearing | 404/95 |
| 2001/0014212 | A1 * | 8/2001 | Rutherford | 392/503 |
| 2006/0045624 | A1 * | 3/2006 | Nelson | 404/95 |
| 2010/0310312 | A1 * | 12/2010 | Mahler et al. | 404/95 |
| 2011/0002737 | A1 * | 1/2011 | Mahler et al. | 404/118 |

FOREIGN PATENT DOCUMENTS

| | | | |
|---|---|---|---|
| DE | 102004002658 | A1 | 1/2004 |
| EP | 0641887 | A1 | 8/1994 |
| EP | 10252012 | A1 | 9/1998 |
| EP | 1555348 | A1 | 10/2004 |
| EP | 1757734 | A1 | 8/2005 |

* cited by examiner

*Primary Examiner* — Gary S Hartmann
(74) *Attorney, Agent, or Firm* — Kilpatrick Townsend & Stockton LLP

(57) ABSTRACT

The invention relates to a device for compacting road paving materials, comprising a screed board which is fastened on a road finisher and extends at a right angle to the direction of travel of the road finisher and a tamper that is mounted in front and/or behind the screed board. The tamper has a tamper strip that can be driven to perform a striking upward and downward movement and the interior of which is equipped with an electrical heating unit in the form of a rod-shaped heating element that can be clamped into a recess of the tamper strip. The device according to the invention is characterized by a spring accumulator receiving a heating element in the direction of the striking upward and downward movement for clamping the heating element.

18 Claims, 6 Drawing Sheets

DEVICE FOR COMPACTING ROAD PAVING MATERIALS

BACKGROUND OF THE INVENTION

1. Field of the Invention

The invention relates to a device for compacting road paving materials.

2. Background

Such a device is known from DE 26 00 108 A1. According to this document, a screed upstream of which is arranged a tamper for precompacting the paving material is fastened to the road finisher. During the beginning of a paving operation, it thus occurs that the bituminous mixture in the warm state remains sticking on the cold tamper strip. However, the mixture sticking on the tamper strip leaves behind grooves in the surfacing which can no longer be removed by the following screed and therefore remain on the surface of the roadway covering. To avoid these grooves at the beginning of a paving operation, it is known to heat the tamper strip. The use of a gas burner has been replaced here by an electrical heater which is inserted into an open or closed hollow profile which forms the tamper strip. The electrical heater is then situated in the interior of the tamper strip.

EP 0 641 887 B1 discloses a road finisher and tool in the form of a tamper strip for a paving screed. The tamper strip forms a channel between a carrier part and a wear part, in which channel a heating element, in particular a heating bar, is provided. The heating element is an electrical flat-tube heating body which is screened upwardly by a shim. Here, the shim ensures that the heating element is securely clamped such that as large a contact surface as possible results for heat conduction. A disadvantage here is that the heating element frequently breaks. The replacement of a defective heating element leads to undesired downtimes of the road finisher. The maintenance requirement is increased. The heating capacity is further determined by the contact heat.

SUMMARY OF THE INVENTION

The object of the invention is therefore to provide a device for compacting road paving materials according to the preamble of claim 1 whose heating element is low-maintenance and has a good heating capacity.

This object is achieved according to the invention by the features of claim 1.

Accordingly, a tamper strip with an electrical heating element is provided whose heating element as a round-tube heating body is particularly robust and can be easily handled by the connection to a connecting block. The heat distribution is improved by the arrangement of the bars. By virtue of its length and deformability, the round-tube heating body looks better than a flat-tube heating body. Finally, it is possible for a round-tube heating body for the cavity in the tamper strip to be dimensioned to be smaller such that the heat losses through convection can be kept low.

The round-tube heating body can be fastened by means of clamping by a holder plate or by elastic deformation. In the case of clamping by elastic deformation, a statically acting energy accumulator can be applied using the elastic change of shape. The energy arising for example from human muscle power when inserting the heating element into the cavity of the tamper strip is thus accumulated in a suitable manner. Here, the energy accumulator element acts preferably in the direction of the striking upward and downward movement for bearing the heating element. The heating element is thus supported within the tamper strip over its length and fastened.

In a striking tamper, the heating element must be secured against oscillations for purely mechanical reasons. The heating element is therefore protected from vibration.

The round-tube heating body is preferably designed as a heating bar in corrugated form or zigzag-shaped form. For fastening, the resilient property of the heating bar is used. This can be automatically clamped in the tamper by means of loaded corrugation.

Alternatively, the deformation of a round-tube heating body which is straight in the unloaded state is possible by means of suitable abutments, such as, for example, a corrugated shim, in order to apply the necessary clamping force.

The tamper strip is preferably a horizontally divided construction which has a carrying strip and an impact strip. Preferably provided within the carrying strip is a groove in which the heating element is situated. Following wear of the impact strip, the carrying strip can thus remain on the machine and be further used. The groove is thus not situated in the wearing part. This choice makes it possible to keep the impact strips cost-effective. Here, the impact strips can be of multi-part design and be bridged by means of a cover plate. The connection surfaces are sealed as a result.

Further refinements of the invention can be taken from the following description and the subclaims.

BRIEF DESCRIPTION OF THE DRAWINGS

The invention is explained in more detail below with reference to the exemplary embodiments illustrated in the appended drawings.

DESCRIPTION OF THE SPECIFIC EMBODIMENTS

Figure 1A:
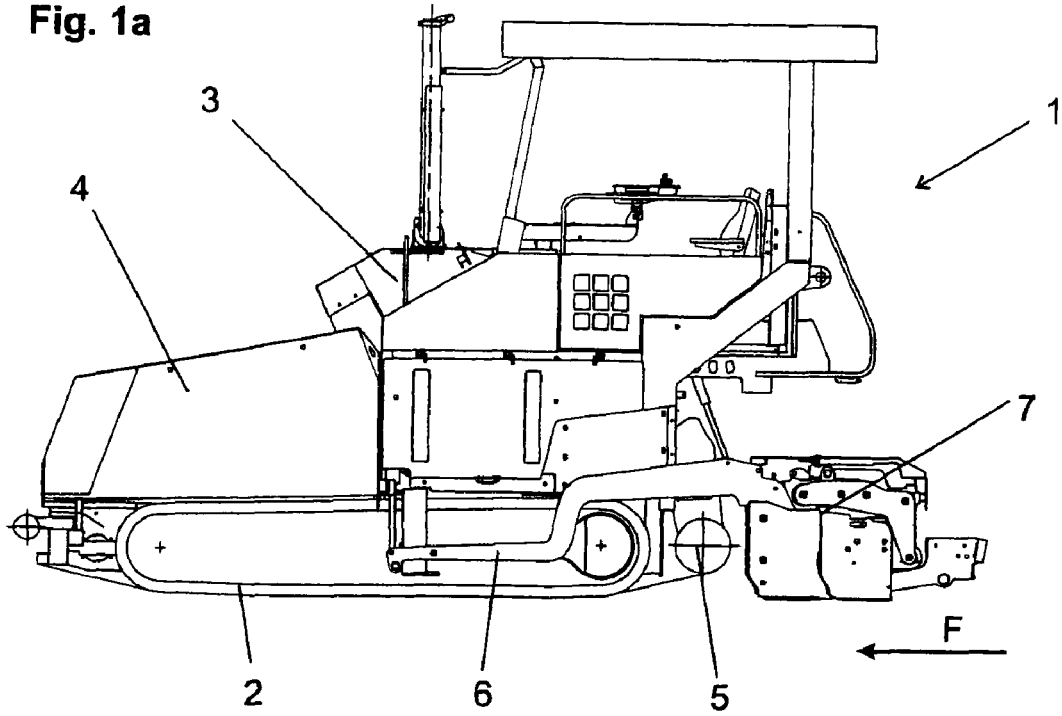
FIG. 1*a* shows a schematic side view of a road finisher.
Figure 1B:
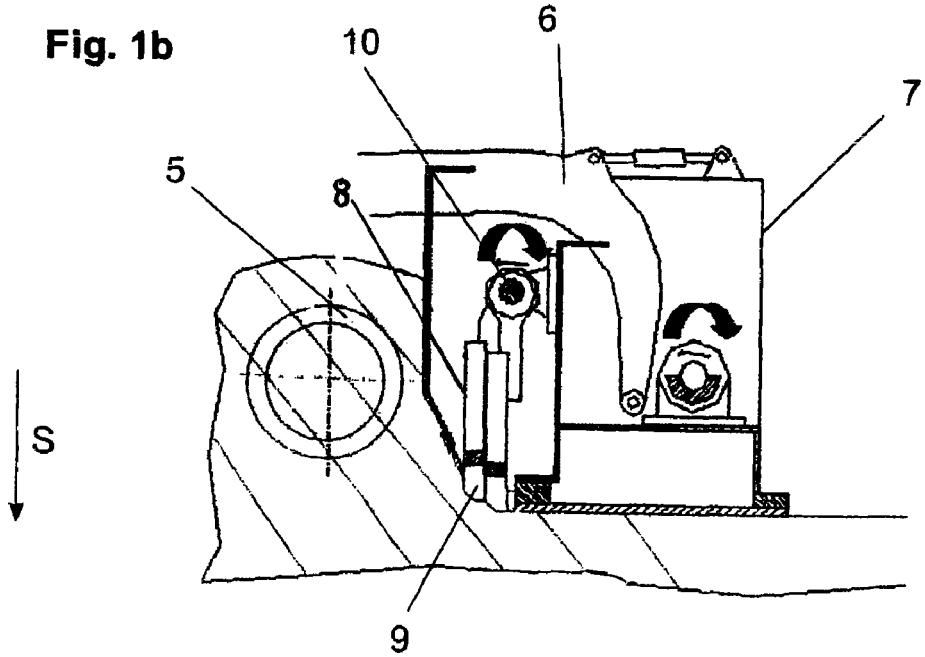
FIG. 1*b* schematically shows a sectional representation of a screed.

The road finisher 1 according to FIG. 1*a* comprises a chassis 2, a drive unit 3, a material bunker 4 situated at the front in the direction of travel and a distribution auger 5 situated behind. Lateral arms 6 are used to tow a screed 7 which lays paving material which is transported rearwardly from the material bunker 4 and distributed by the distribution auger 5. The screed 7 is preferably a vibrating screed which smooths and compacts. At least one tamper 8, as is represented in FIG. 1*b*, is arranged at the side of the paving screed 7 situated at the front in the direction of travel F. According to FIG. 1*b*, two tampers 8 are arranged behind one another. This is accordingly a double tamper screed. Furthermore, a tamper 8 can also be arranged downstream of the screed 7. The screed 7 can have a fixed working width or be laterally extendable as an extension screed for larger working widths. The tamper 8 arranged in front of the screed 7 in the direction of travel F operates as a precompacting element.

FIGS. 1*a* and 1*b* thus show a device for compacting road paving materials, comprising a screed 7 which is fastened to a road finisher 1 and extends transversely to the working direction of the finisher 1, and a tamper 8 which is arranged upstream of said screed. The tamper 8 described below can preferably additionally or alternatively be arranged downstream of the screed 7.

The tamper 8 has a tamper strip 9 which can be driven to perform a striking upward and downward movement. A drive 10 is provided for driving the tamper strip 9.

Figure 2:
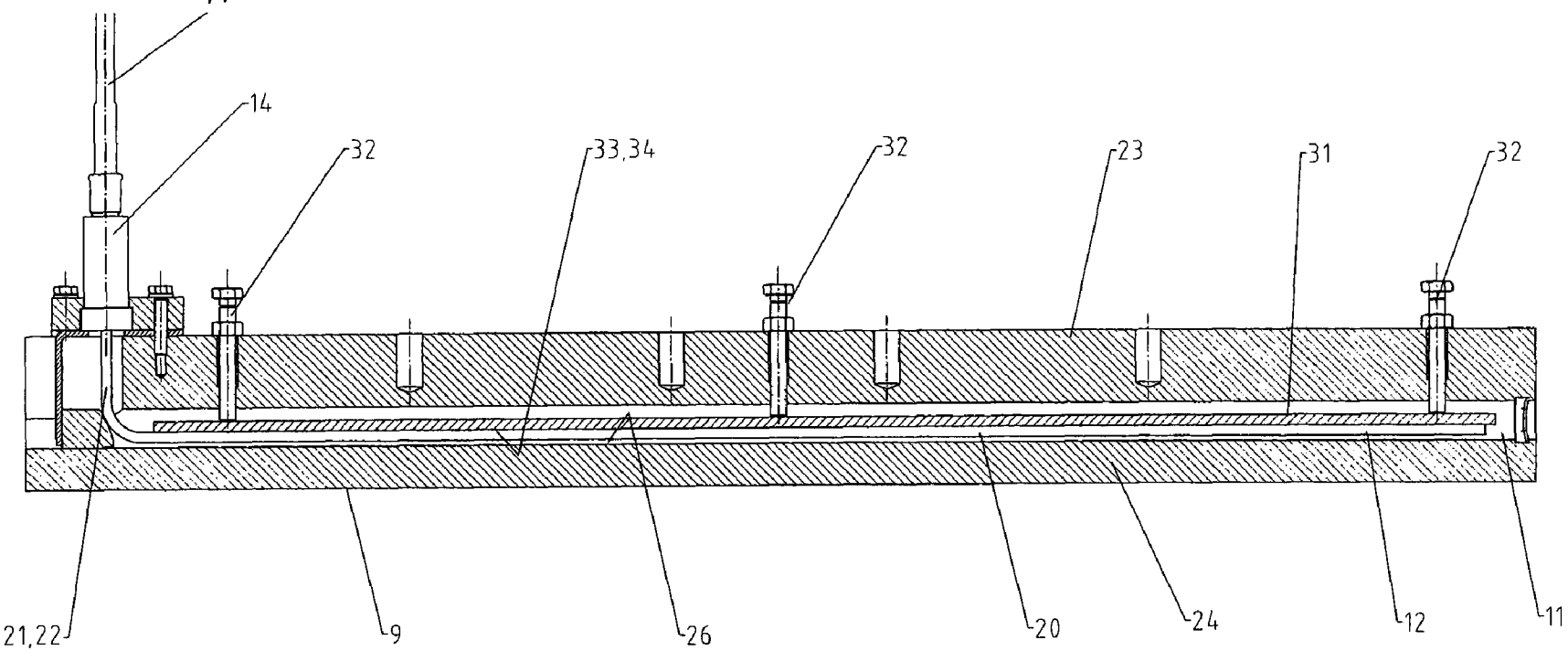
FIG. 2 schematically shows in section a tamper strip according to a first exemplary embodiment, FIG. 3 schematically shows in section a tamper strip according to a second exemplary embodiment, FIG. 4 schematically shows in section a tamper strip according to a third exemplary embodiment, FIG. 5 schematically shows a section A-A according to FIG. 4, FIG. 6 schematically shows a section according to FIG. 4 when inserting the heating element, FIG. 7 schematically shows in section a tamper strip according to a fourth exemplary embodiment, FIG. 8 schematically shows a section G-G according to FIG. 7.
Figure 3:
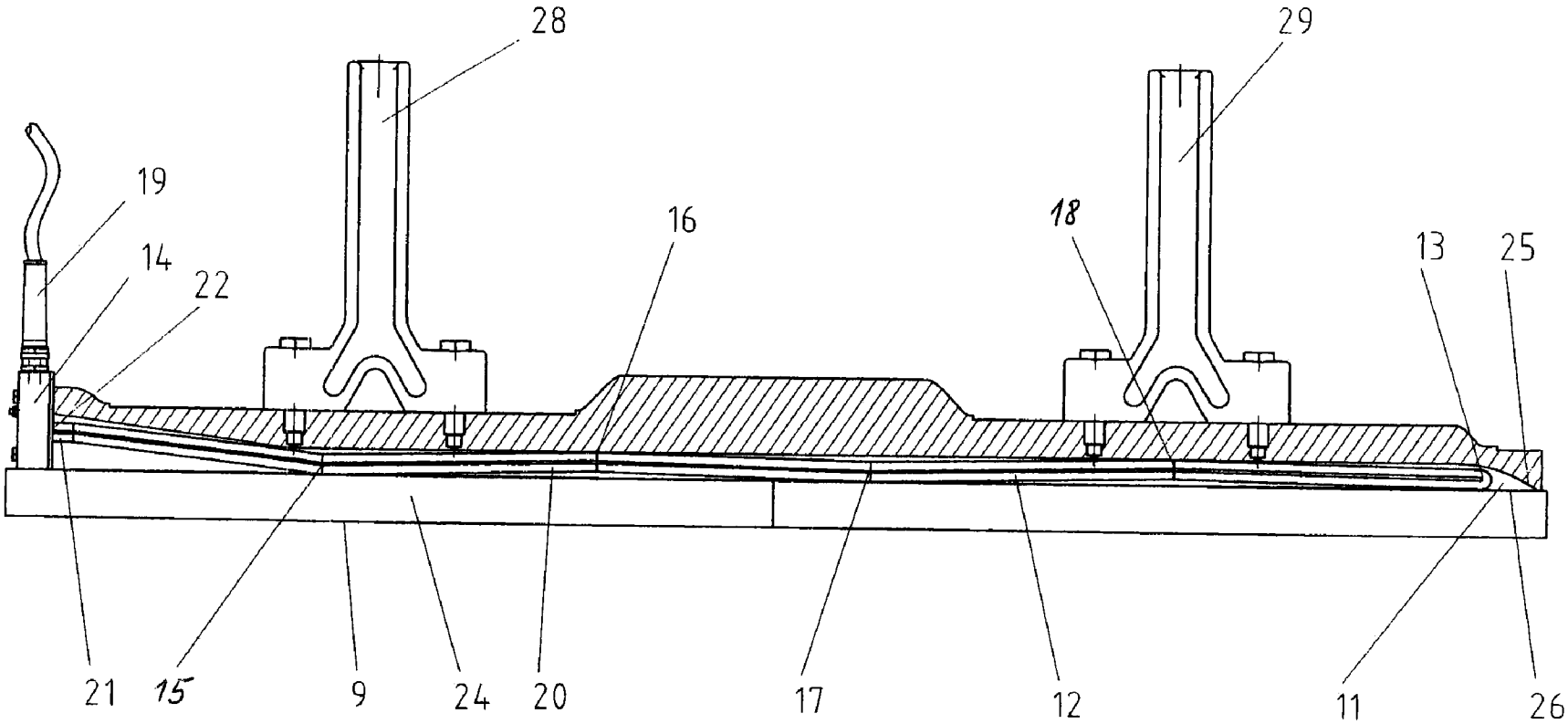

As shown in FIGS. 2 and 3, the interior of the tamper strip 9 is equipped with an electrical heater in the form of a bar-shaped heating element 12 which can be clamped in a cavity 11 of the tamper strip 9. The cavity 11 forms an enclosed space for the heating element 12. The heating element 12 is formed by a round-tube heating body whose heating filament 20 is at least folded over once at a free end of the round-tube heating body to form two bars 33, 34 arranged adjacently to one another. According to FIG. 2, the two bars 33, 34 are next to one another. According to FIG. 3, the two bars 33, 34 lie above one another.

According to FIG. 2, in order to clamp the heating element 12, a holding strip 31 is provided which by means of screws 32 presses the heating element 12 onto a bottom 26 of the cavity 11 such that said heating element lies in a play-free manner in the cavity 11.

According to FIG. 3, in order to clamp the heating element 12, a spring accumulator which bears the heating element 12 in the direction of the striking upward and downward movement S is provided. The spring accumulator achieves clamping by elastic deformation. The spring accumulator clamps the heating element 12 along the cavity 11 in such a way that the heating element 12 lies in a stabilized or play-free manner in the cavity 11. The thermal expansion of the heating element 12 in the direction of a free end 13 is provided for.

The cavity 11 can have a round or angular cross section; it can be formed by a core drilling or it can be designed as a closed groove.

As shown in FIG. 2 and FIG. 3, exchanging the heating element 12 is additionally noticeably simpler if it is fastened only to the end side of the tamper 8 via a connecting block 14. The heating element 12 is electrically connected via the connecting block 14 to a power source, for which purpose a connection cable 19 is provided. The connecting block 14 is fastened to the tamper strip 9.

Figure 6:
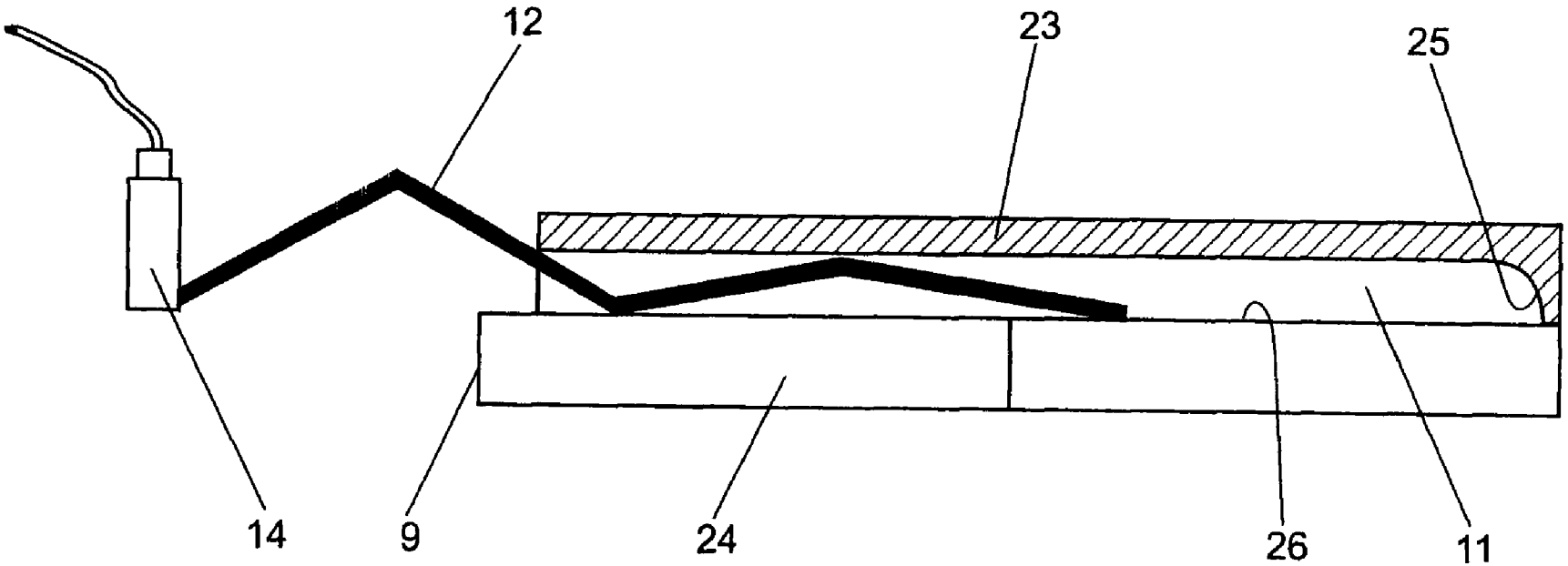

According to the second exemplary embodiment shown in FIG. 3 the heating element 12 is preferably designed as a corrugated, bent or zigzag-shaped heating bar whose elastic change in shape forms the spring accumulator. The heating element 12 is seated elastically prestressed in the cavity 11 of the tamper strip 9. The cavity 11, which extends along the tamper strip 9, thus has dimensions, in particular in terms of height and width, which define the elastic deformation of the heating element 12 and hence the prestress (cf. FIG. 6). The elastic change of shape of the heating element 12 is used, for which purpose the thickness of the corrugation or the zigzag shape of the heating bar with respect to the cavity 11 is selected. FIG. 6 shows for example the energy arising from human muscle power (when inserting the heating element 12) for building up the statically acting spring accumulator while using the elastic change of shape. The independent clamping of heating bars as heating elements 12 is not dependent on the tube shape.

The number of corrugations of the bending points 15, 16, 17, 18 can vary. However, at least one bending point is required. The axis of the bending can vary. According to FIG. 3, the bending points are situated in a plane. However, this is not absolutely necessary.

Figure 8:
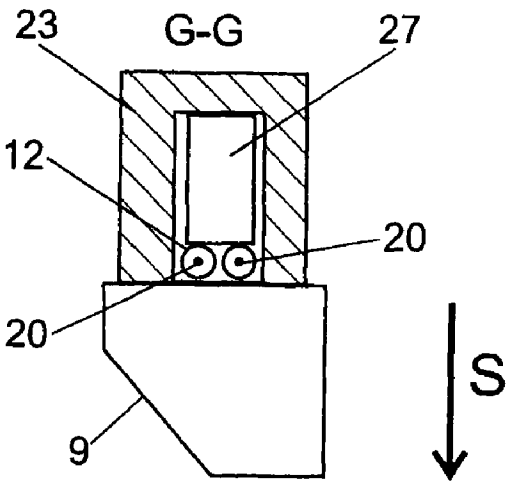
Figure 7:
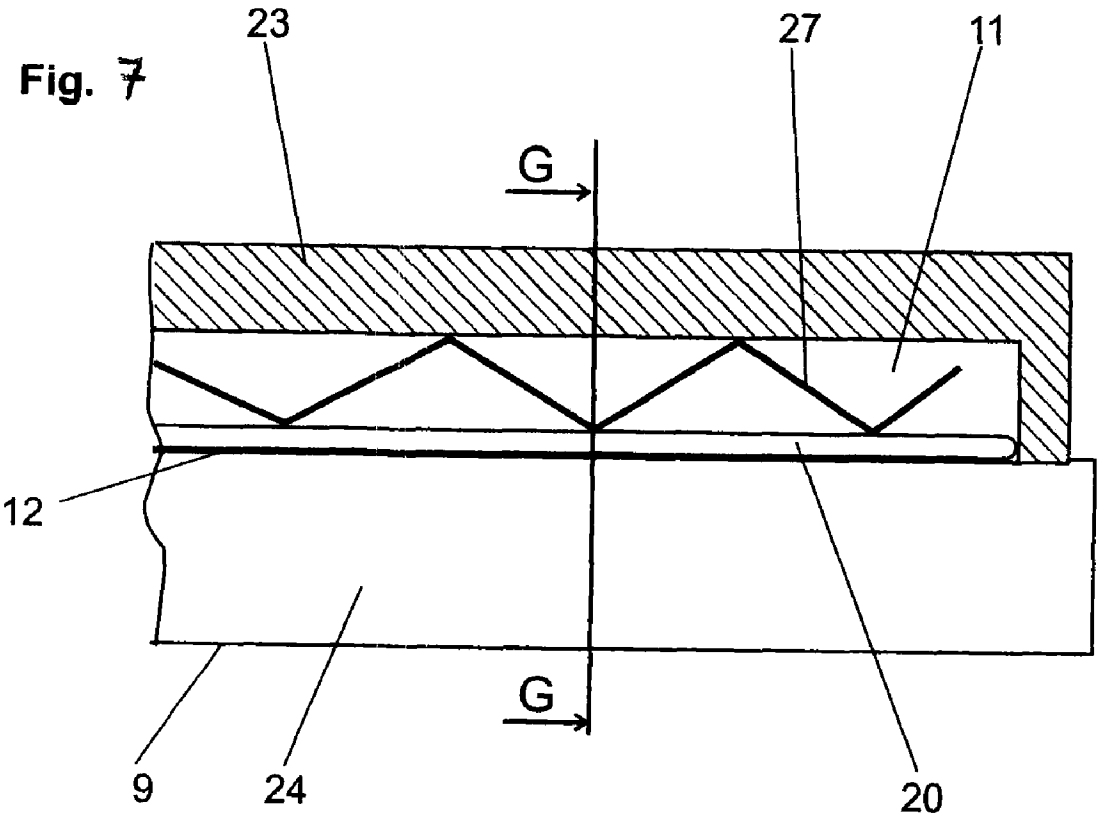

FIG. 6 shows the insertion of a heating element 12 according to FIG. 3 in the cavity 11 of the tamper strip 9. Finally, the resilient clamping action can also be separated from the actual heating element 12. Here, use is made of an additional, nonheated shim of corrugated or bent shape in order to clamp the heating element 12, as is represented in FIGS. 7, 8.

As shown in FIG. 3, the heating element 12 is designed as a round-tube heating bar. This round-tube heating bar has only one heating filament 20 whose free end 13 is folded over and guided back. The start 21 and end 22 of the one heating filament 20 are connected and fastened to the one connecting block 14. By using a round-tube heating bar with a folded-over heating filament 20, the cavity 11 can be designed to be small. The thus reduced convection provides a large saving potential of heat loss to the benefit of heat conduction and heat radiation. The heating filament 20 transfers heat to the tamper strip 9, with the contact to the tamper strip 9 no longer being paramount as in the case of flat-tube heating bodies. The folded-over heating filament 20 forms a heating assembly with two bars 33, 34 of the heating filament 20 of a round-tube heating body arranged above or next to one another, said bars being connected in a common connecting block 14 to an electrical supply line 19.

The four bending points 15, 16, 17, 18 provided according to FIG. 3 are chosen such that the heating element 12 builds up enough spring stress in order to be sufficiently firmly clamped in the tamper strip 9 during the operation of the tamper 8. The heating element 12 as a round-tube heating body has a good bending property.

According to FIG. 3, the tamper strip 9 preferably comprises a carrying strip 23 and an impact strip 24. The tamper strip 9 is thus divided horizontally. In order to form the cavity 11 in an enclosed space of the tamper strip 9, the carrying strip 23 preferably contains a groove 25 in which the heating element 12 is situated. The groove 25 is closed via a top surface 26 of the impact strip 24 to form the cavity 11. After wearing of the impact strip 24, the carrying strip 23 can remain on the finisher 1 and be further used. The groove 25 can thus be made in a nonwearing part.

The impact strip 24 can be composed of a plurality of impact strip segments. The impact strip 24 can for example have at least two impact strip segments arranged behind one another. The impact strip segments can be bridged by a cover plate. The cover plate can then form the top surface 26 for delimiting the cavity 11.

Furthermore, the impact strip 24 is preferably designed as a thin-walled profile. The carrying strip 23 can be adapted as carrying body to the use conditions. For example, the carrying strips 23 can have a projecting pedestal 30 on its top side for component reinforcement. The tamper 8 is fastened to the drive 10 for example via arms 28, 29 on the tamper strip 9.

According to FIG. 2, the cavity 11 is formed in a tamper strip 9 in which the carrying strip 23 is formed in one piece with the impact strip 24. The cavity 11 can then be formed, for example, by a core drilling.

Figure 5:
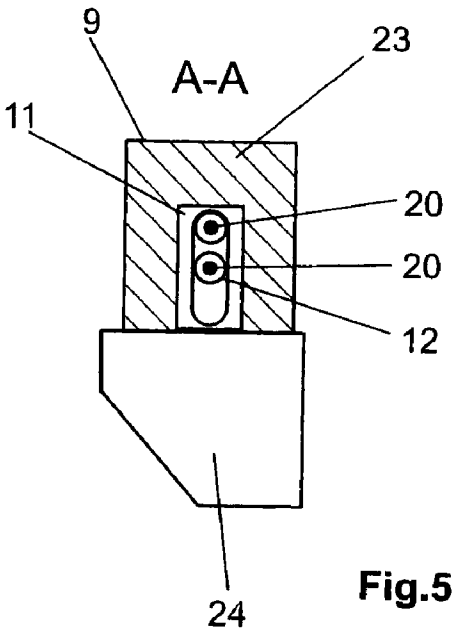
Figure 4:
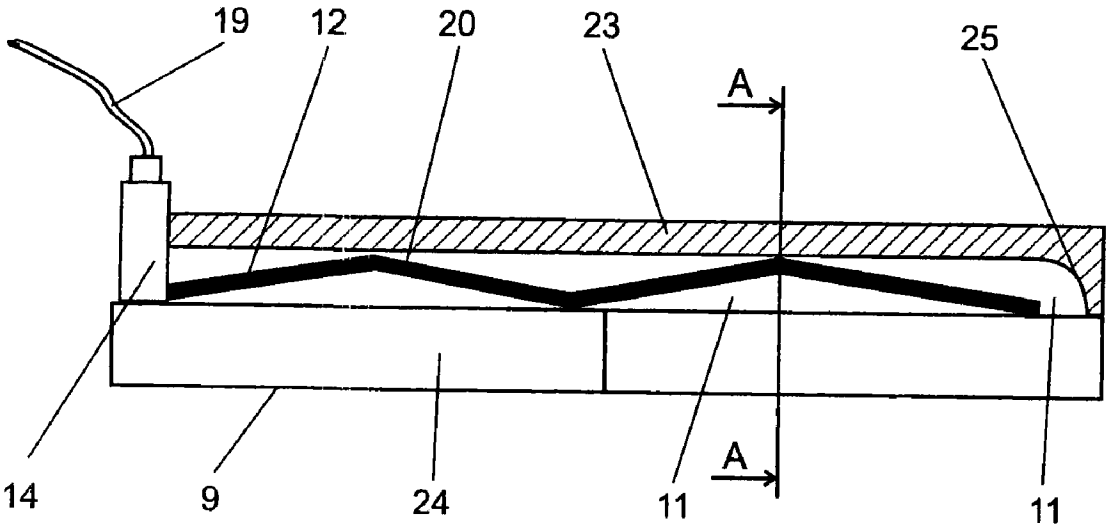

FIG. 4 and FIG. 5 show the tamper strip 9 according to FIG. 3 with two bars of the heating filament 20 of a round-tube heating body which are arranged above one another. The cavity 11 is closed at the end face of the tamper strip 9 by the connecting block 14. As shown in FIG. 6, the heating element 12 is more greatly bent before installation than in the mounted state. During the mounting operation, for example through the application of human muscle power, the heating element 12 is pushed laterally into the groove 25 between the carrying strip 23 and impact strip 24. In the meantime, the heating element 12 deforms elastically and if appropriate proportionally plastically into a prestressed form to such an extent that it fills the groove 25. The proportion of the elastic deformation causes the clamping. The length of the cavity 11 is dimensioned in such a way that the heating element 12 can expand toward the free end by a sliding movement. As shown in FIG. 5, the heating element 12 in the closed system of the cavity 11 is completely enveloped by the tamper strip. No direct contact between the heating element 12 as round-tube heating body and impact strip 24 is required. The surface temperature of the round-tube heating body is increased in comparison to a flat-tube heating body with contact. The round-tube heating body is suitable for this higher temperature. The proportion of the heat flow from the reduced contact heat transfer of the round-tube heating body is therefore in particular divided between heat radiation and convection as heat transfer types.

According to FIG. 7 and FIG. 8, the spring accumulator provided is a corrugated or bent shim 27 whose elastic change of shape forms the spring accumulator. Here, the resilient clamping action is separated from the actual heating element 12. The shim 27 is an additional, preferably nonheated element of corrugated or bent shape which clamps the heating element 12.

The invention claimed is:

1. A device for compacting road paving materials, comprising a screed which is fastened to a road finisher and extends transversely to the working direction of the finisher, and a tamper which is arranged upstream and/or downstream of said screed and which has a tamper strip which can be driven to perform a striking upward and downward movement (S), said tamper strip being equipped in its interior with an electrical heater in the form of a bar-shaped heating element which can be clamped in a cavity of the tamper strip, characterized in that the heating element is a round-tube heating body whose heating filament is folded over at least once at a free end of the round-tube heating body to form two bars arranged adjacently to one another which are connected in a common connecting block to an electrical supply line.

2. The device as claimed in claim 1, characterized in that the heating filament is designed as a single rod.

3. The device as claimed in claim 1, characterized in that the heating filament forms two rods arranged above or next to one another.

4. The device as claimed in claim 1, characterized in that the connecting block closes the cavity to form a closed space.

5. The device as claimed in claim 1, characterized in that the connecting block is arranged at an end face of the tamper strip.

6. The device as claimed in claim 1, characterized in that the tamper strip has a carrying strip and an impact strip and the cavity is formed in the carrying strip.

7. The device as claimed in claim 6, characterized in that the carrying strip has a groove which is closed via a top surface of the impact strip to form the cavity.

8. The device as claimed in claim 6, characterized in that the carrying strip has a pedestal projecting on the top side for component reinforcement.

9. The device as claimed in claim 6, characterized in that the impact strip has at least two impact strip segments arranged one behind the other.

10. The device as claimed in claim 9, characterized in that the impact strip segments are bridged by a cover plate.

11. The device as claimed in claim 10, characterized in that the cover plate forms the top surface for delimiting the cavity.

12. The device as claimed in claim 6, characterized in that the impact strip is designed as a thin-walled profile.

13. The device as claimed in claim 1, characterized in that, in order to clamp the heating element, a spring accumulator which bears the heating element in the direct of the striking upward and downward movement is provided.

14. The device as claimed in claim 13, characterized in that the spring accumulator is formed by elastic deformation.

15. The device as claimed in claim 13, characterized in that the spring accumulator clamps the heating element along the cavity in such a way that it lies in a play-free manner in the cavity.

16. The device as claimed in claim 13, characterized in that the heating element is designed as a corrugated or zigzag-shaped heating bar whose elastic change in shape forms the spring accumulator.

17. The device as claimed in claim 13, characterized in that the spring accumulator is designed as a corrugated or zigzag-shaped shim whose elastic change in shape forms the spring accumulator.

18. The device as claimed in claim 1, characterized in that, in order to clamp the heating element, a holding strip which bears the heating element in the direction of the striking upward and downward movement is provided.

* * * * *